US010477891B1

(12) United States Patent
Robertson

(10) Patent No.: US 10,477,891 B1
(45) Date of Patent: Nov. 19, 2019

(54) SMOKING SYSTEM AND METHOD UTILIZING SMOKE CLEANSING AND CONDITIONING COMPONENTS

(71) Applicant: Geoffrey Sanders Robertson, Frazier Park, CA (US)

(72) Inventor: Geoffrey Sanders Robertson, Frazier Park, CA (US)

( * ) Notice: Subject to any disclaimer, the term of this patent is extended or adjusted under 35 U.S.C. 154(b) by 0 days.

(21) Appl. No.: 16/294,068

(22) Filed: Mar. 6, 2019

Related U.S. Application Data

(60) Provisional application No. 62/639,632, filed on Mar. 7, 2018.

(51) Int. Cl.
*A24F 1/30* (2006.01)
*A24F 47/00* (2006.01)
*A24F 1/06* (2006.01)

(52) U.S. Cl.
CPC ..... *A24F 1/30* (2013.01); *A24F 1/06* (2013.01); *A24F 47/008* (2013.01)

(58) Field of Classification Search
CPC combination set(s) only.
See application file for complete search history.

(56) References Cited

U.S. PATENT DOCUMENTS

| | | | | |
|---|---|---|---|---|
| 10,299,510 | B1 * | 5/2019 | Rhodes | A24F 1/30 |
| 10,321,714 | B1 * | 6/2019 | Kane | A24F 47/008 |
| 2008/0029107 | A1 * | 2/2008 | Ruff | A24F 1/30 131/173 |
| 2016/0021929 | A1 * | 1/2016 | Sawalha | A24F 47/002 131/329 |
| 2018/0311710 | A1 * | 11/2018 | Gilmore | B08B 17/02 |

* cited by examiner

*Primary Examiner* — Eric Yaary
(74) *Attorney, Agent, or Firm* — James M. Duncan, Esq.; Klein DeNatale Goldner

(57) ABSTRACT

A smoking system has a combustion chamber in which tobacco, herbal substances, and the like are combusted. Product smoke is received within a conduit member and flows upward within the conduit member. An element member is axially disposed within the conduit member, where the element member is configured to rotate within the conduit member. As the smoke flows upward, it encounters a water mist which is flowing downward through the conduit member, thereby cleaning, cooling and filtering the upwardly traveling smoke. Cleaned smoke flows to the top of the conduit member where it is delivered to the user through a delivery tube connected at the upward end of the conduit member, such that the smoke reaching the consumer is cooled and cleansed.

19 Claims, 6 Drawing Sheets

SMOKING SYSTEM AND METHOD UTILIZING SMOKE CLEANSING AND CONDITIONING COMPONENTS

RELATED APPLICATIONS

This application claims domestic priority to U.S. Provisional Application 62/639,632 filed Mar. 7, 2018.

BACKGROUND OF THE INVENTION

The present invention generally relates to equipment, systems and methods which are used for personal smoking of tobacco, herbal substances, and the like, sometimes referred to herein as a "personal smokable substance".

The smoking of a variety of personal smokable substances for personal pleasure and relaxation and for therapeutic purposes has been known for hundreds of years or more. Smoking systems for these personal smokable substances have ranged from simply combusting the substance at a close proximity and inhaling the smoke to a variety of devices which contain the substance as it is combusted and direct the resulting smoke to the mouth or nose of the consumer for inhalation or puffing. Simple smoking systems, such as pipes, comprise a combustion chamber or bowl and a stem attached to the bowl. More complicated smoking systems, such as that disclosed herein, filter or process the smoke between the point of combustion and the point the smoke is consumed by the user.

The smoke is filtered to remove particulates and toxicants which may be carried in the smoke, such as ash and tar. Tar includes polycyclic aromatic hydrocarbons which may be carcinogenic. In some cases, simple paper filters may be utilized for such filtering. The smoke may also be cooled and moistened, which increases the pleasure to some smokers. Water pipes use water filtration to cool the smoke and filter out particulates and toxicants.

The effective removal of impurities from inhaled or puffed smoke is a desirable feature of a smoking system. The more effective the removal of impurities the better, but such a system should be reasonably affordable to consumers and should be relatively easy to transport. A smoking system is desirable which is very effective in removing impurities from the smoke prior to inhalation or puffing by a consumer, but which system remains relatively inexpensive and portable.

SUMMARY OF THE INVENTION

Embodiments of the present invention provide a solution to the above-identified need. An embodiment of the present smoking systems has a chamber in which a product is combusted to produce smoke for inhalation or puffing. A conduit member is connected to the chamber, where the conduit member has an upward end and a lower end. The product smoke flows into the conduit member from the chamber and flows toward the upward end. A longitudinal element member is disposed within the conduit member, thereby creating a flow channel or annulus between the exterior of the element member and the interior wall of the conduit member. The longitudinal element member itself has an internal tube which extends through the length of the longitudinal element member. The longitudinal element member comprises at least one radially facing outlet which connects the internal tube to the flow channel or annulus in the space between the exterior of the longitudinal element member and the interior wall of the conduit member. A water delivery mechanism delivers water to the upward end of the conduit member. The water flows from the upward end of the conduit member and downward into the internal tube. A mechanism causes the element member to spin within the conduit member. As the element member spins, water contained in the internal tube flows through the radially facing outlet into the inside space of the conduit member. Once in the inside space of the conduit member, the water falls through the conduit member towards the lower end. As the water falls through the conduit member, it encounters product smoke flowing toward the upper end.

The falling water droplets form a fine mist which fully occupies the inside space of the conduit member, such that all rising smoke encounters the mist. The water mist is very effective in stripping from the product smoke the impurities, particulates and toxicants which are carried within the smoke, and in cooling the smoke. The cleaned smoke flows to the top of the conduit member where it is delivered to the user through a delivery tube connected at the upward end of the conduit member, such that the smoke reaching the consumer is cooled and cleansed.

DETAILED DESCRIPTION OF THE INVENTION

Figure 1:
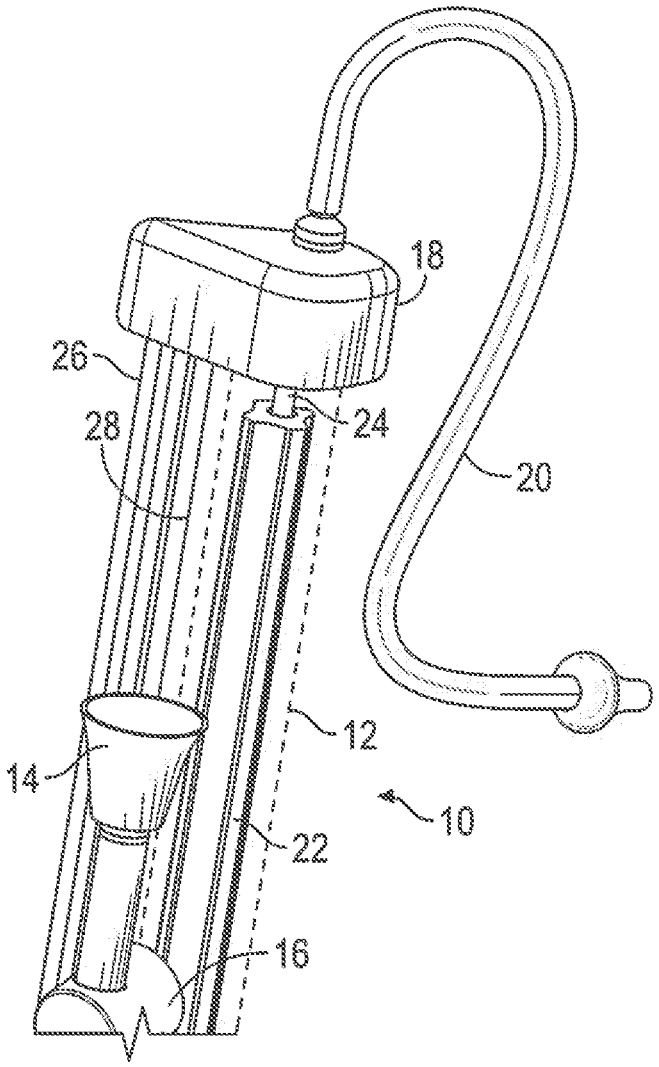
FIG. 1 depicts a portion of an isometric view of an embodiment of the present invention.

Referring now to the Figures, a conceptualized view of a portion of an embodiment of the disclosed smoking system 10 is depicted in FIG. 1. Embodiments of the present invention may be sized to be easily carried in the hand of a user. As shown in FIG. 1, an embodiment of the present invention generally comprises a conduit member 12, a combustion chamber 14, an adapter 16 which attaches the combustion chamber 14 to the conduit member, an upper receiver 18, a smoke delivery tube 20, an element member 22 contained within the conduit member 12, an internal tube 24 contained within the element member 22, a water supply line 26, and support members 28, such as long, small diameter rods or bolts. Conduit member 12 will typically be configured in a vertical or near-vertical orientation because gravity encourages the counter-current flow of smoke and water. The disclosed smoking system 10 comprises additional elements not shown in FIG. 1, but depicted in the Figures discussed below.

Figure 2:
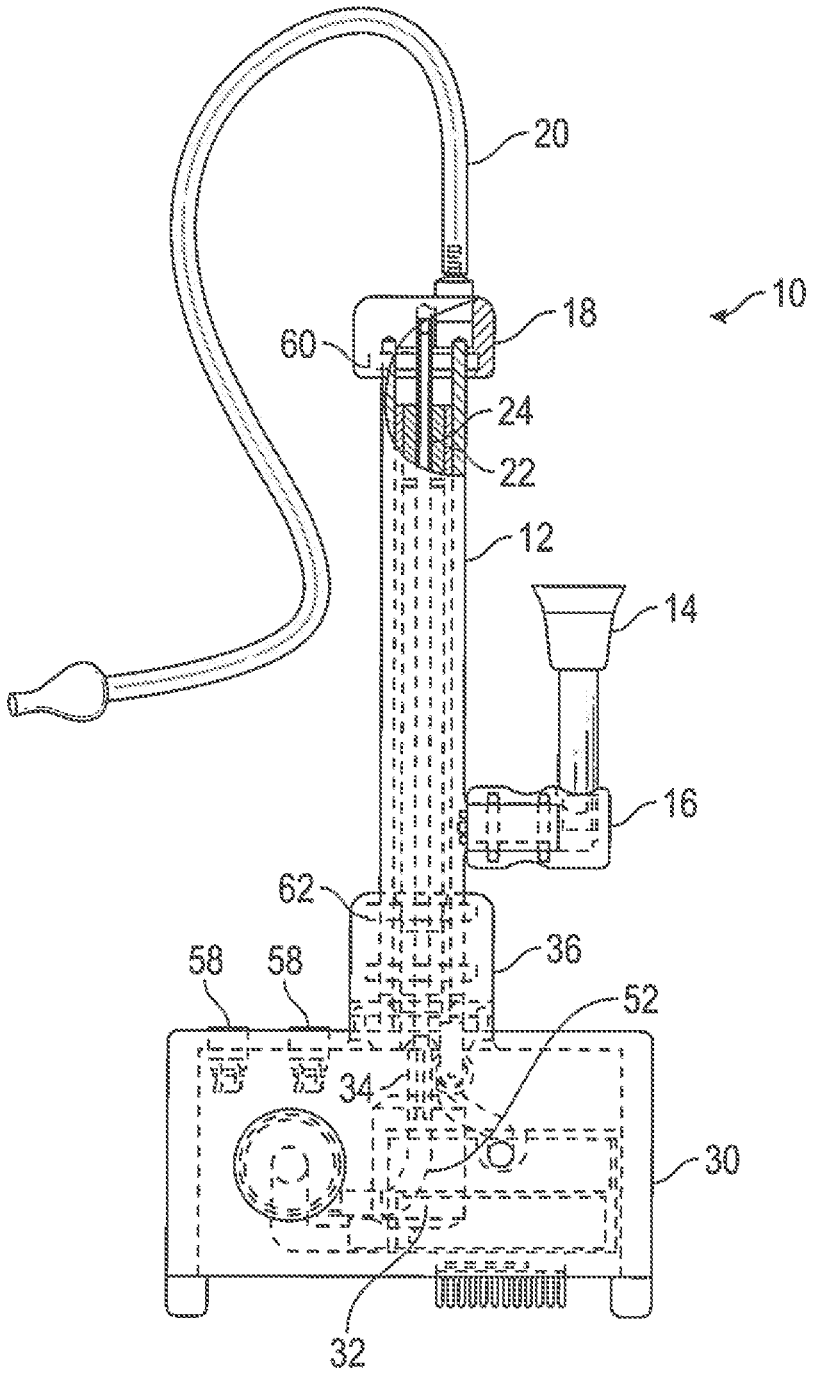
FIG. 2 depicts a front elevational view of an embodiment of the present invention.
Figure 3:
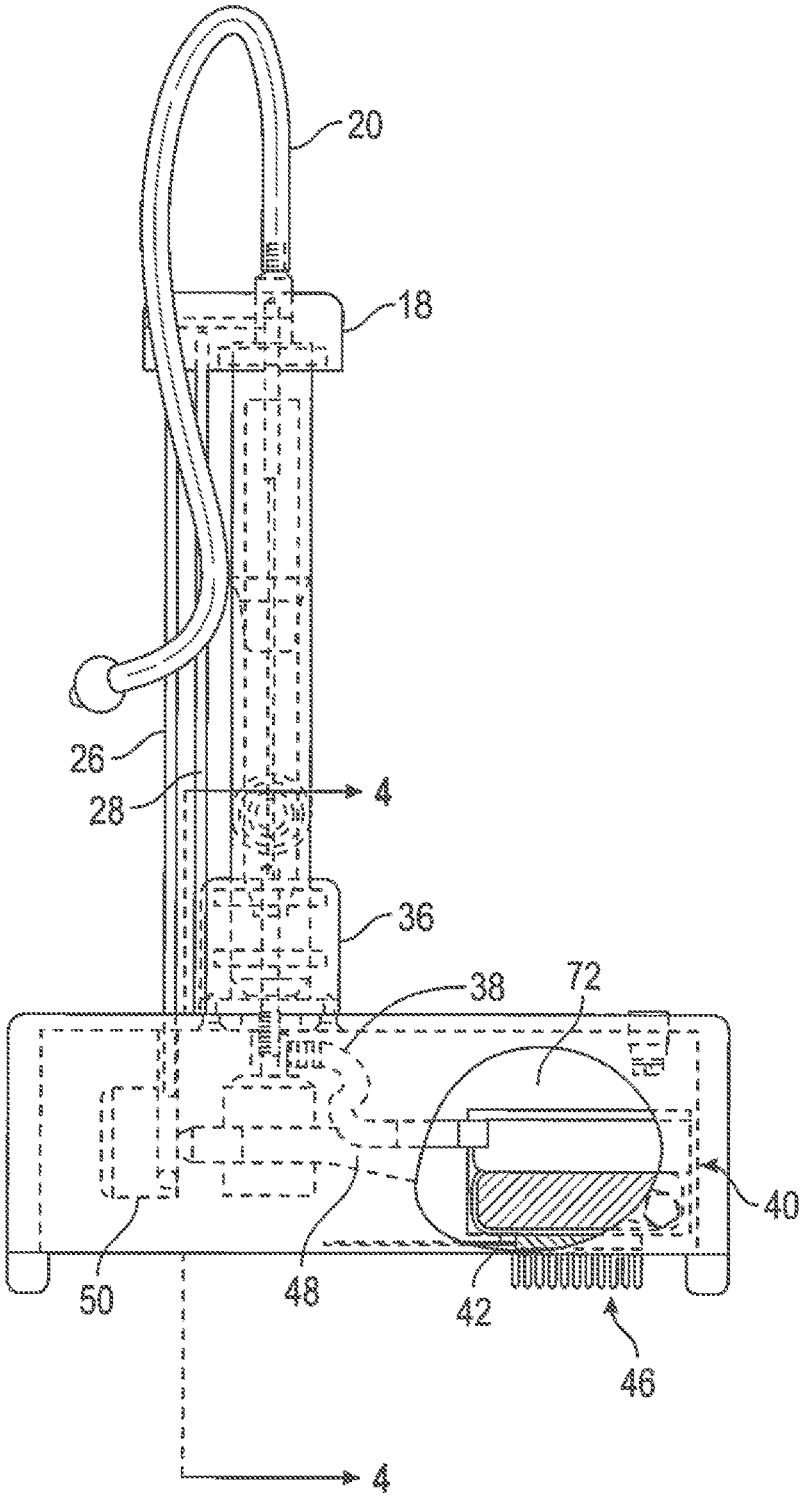
FIG. 3 depicts a left side view of an embodiment of the present invention.
Figure 4:
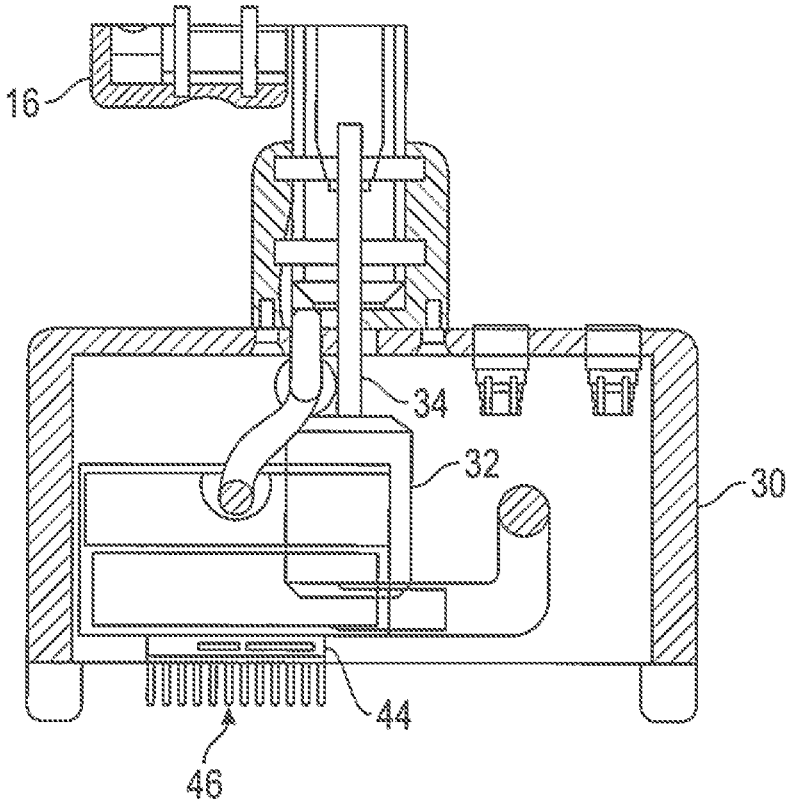
FIG. 4 depicts a sectional view taken along line 4-4 of FIG. 3.
Figure 5:
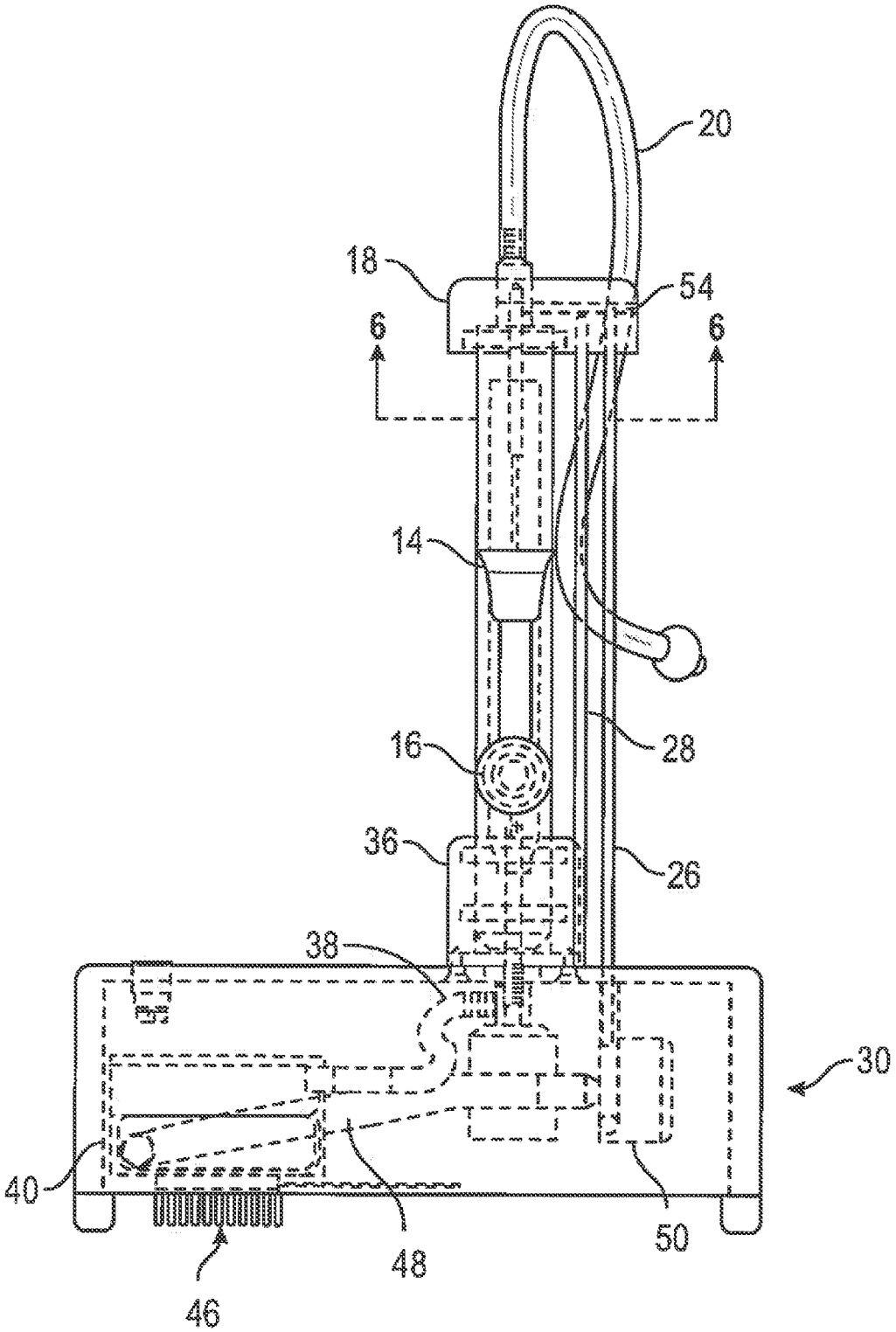
FIG. 5 depicts a right side view of an embodiment of the present invention.

FIG. 2 depicts a left side elevational view of an embodiment of the disclosed smoking system 10. As shown in FIG. 2, an embodiment of the smoking system 10 may further comprise a base 30. Various components of the smoking system 10 may be located in the base 30. Because element member 22 spins within conduit member 12, some means for spinning the element member is required. A variety of different linkage devices may be utilized to accomplish the spinning, including belts, gears or, as shown in the embodiment depicted in the figures, a direct drive system. In this embodiment a rotation means, such as a motor 32, has a shaft 34 or other connection linkage which connects the rotation means to the element member 22. The internal tube 24 may be utilized as an axle to which connection linkage, such as shaft 34, attaches and imparts rotation generated by the motor 32 or other rotation means. It is to be appreciated that the motor 32 or other rotation means will spin the element member at a high rotational velocity, including speeds ranging from 3500 up to 6000 revolutions per minute. The spinning element member 22 induces turbulence which creates intense contact between rising smoke and falling water within conduit member 12.

Base 30 may further comprise components of a water circulation system. Embodiments of the present invention will have a source of water which is delivered to the internal tube 24 disposed within the element member 22. Embodiments of the disclosed smoking system 10 may have either an open water circulation system or a closed water circulation system. With the open water circulation system, fresh water is supplied to the system for each use, with the water either stored within an water reservoir integral to the apparatus or provided from a separate source. With the closed system, water circulating through the system is utilized, treated, stored, and reused.

Upon the fast rotation of the element member 22, the water is caused by the fast rotation to vigorously flow out of ports in the element member into an annular space between the conduit member 12 and the element member. The spinning element member 22 induces turbulence thereby creating intense contact between the water droplets or mist, which is falling, and smoke which is rising in the annular space of the conduit member 12. The falling water droplets are collected, such as within lower receiver 36. From lower receiver 36 the collected water may flow through drain tube 38 into reservoir 40. Reservoir 40 may comprise a removable filter basket 42 and may also have a water treatment media, such as an activated carbon pouch. Reservoir 40 may further comprise a lid 72. Water circulating within reservoir 40 may be heated or cooled with a Peltier type thermoelectric type heat pump 44 to control the humidity of the smoke mitted through smoke delivery tube 20. A heat sink 46 may be utilized to cool the heat pump 44.

Intake tube 48 supplies water from reservoir 40 to pump 50. Pump 50 or other water delivery mechanism, provides water into water supply line 26 through supply tube 52 or other conduit. Water flows through water supply line 26 up into upper receiver 18. Upon flowing into upper receiver 18, water flows through upper receiver supply tube 54 into internal tube 24 at the upward end of the conduit member 12.

Figure 6:
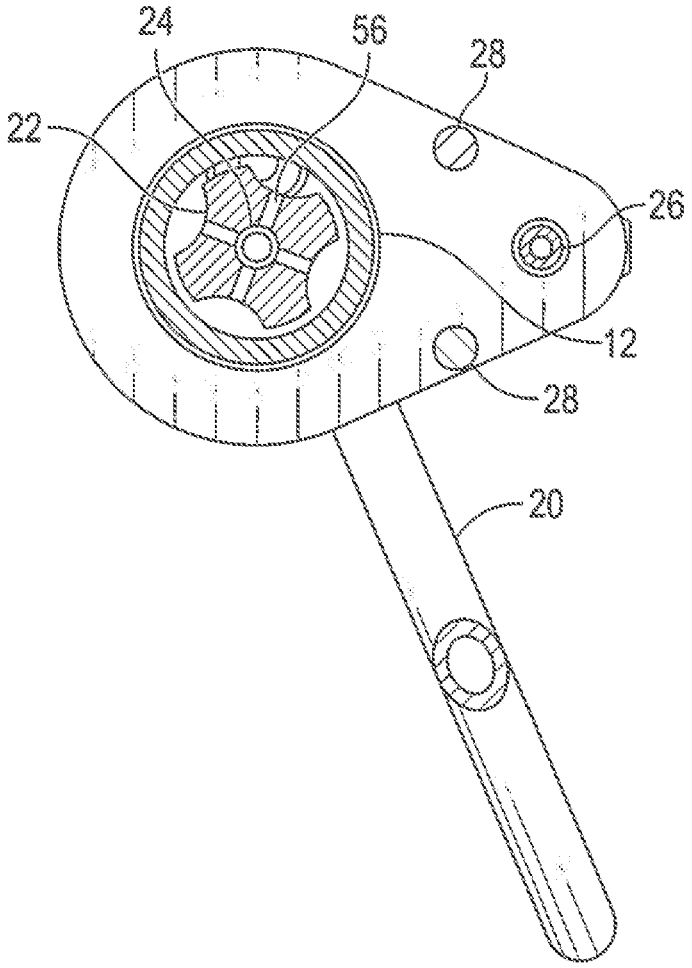
FIG. 6 depicts a sectional view taken along line 6-6 of FIG. 5.

FIG. 6 depicts a sectional view of upper receiver 18, showing the conduit member 12, the smoke delivery tube 20, the element member 22, the internal tube 24, the water supply line 26, and support members 28. FIG. 6 also shows the ports 56 of the element member 22. The ports 56 may comprise four radial holes through which water delivered into the element member 22 is sprayed out into the annulus between the element member 22 and the conduit member 12 as the element member is rapidly spun.

Upper O-ring gland 60 supports and seals the conduit member 12 at the upward end. Likewise, lower O-ring gland 62 supports and seals the conduit member 12 at the lower end.

Conduit member 12 will typically be fashioned from a borosilicate glass contact tube. An acceptable motor 32 may be a micro DC motor Model No. TRS-365RH manufactured by TSINY. An acceptable pump 50, which includes the drive motor, may be a brushless DC water pump Model No. LGBL33-02 distributed by Dongguan Lu GE Electrics Technology Co., Ltd. Batteries for both the motor 32 and the pump 50 may be contained within base 30. Base 30 may further comprise control elements 58 which may be utilized for operating the various operations of embodiments of the disclosed smoking system.

Having thus described the preferred embodiment of the invention, what is claimed as new and desired to be protected by Letters Patent includes the following:

1. A smoking system comprising:

a combustion chamber in which a product is combusted resulting in product smoke;

a conduit member connected to the chamber, the conduit member having an upward end and a lower end, wherein the product smoke flows into the conduit member from the chamber and towards the upward end;

an element member supported within the conduit member, wherein the element member is configured to rotate within the conduit member;

a water delivery mechanism which delivers water to the upward end of the conduit member wherein the water is introduced into an internal tube of the element member and dispensed into the conduit member as the element member rotates;

a motor mechanically connected to the element member, wherein the motor provides rotation to the element member; and a smoke delivery tube attached at the upward end of the conduit member.

2. The smoking system of claim 1 wherein the element member is configured to rotate up to 6,000 RPM.

3. The smoking system of claim 1 wherein the element member comprises at least one radially facing outlet which provides a hydraulic passage for the water to dispense into the conduit member.

4. The smoking system of claim 1 wherein the water delivery mechanism comprises a reservoir which stores and circulates the water.

5. The smoking system of claim 4 wherein the water delivery mechanism comprises a pump.

6. The smoking system of claim 4 wherein the reservoir comprises a water filtering unit.

7. The smoking system of claim 4 wherein the water is heated within the reservoir.

8. The smoking system of claim 4 wherein the water is cooled within the reservoir.

9. A method of cleansing a smoke produced by a personal smokable substance comprises the following steps:

conveying the smoke from a combustion chamber to an upper end of a conduit member thereby creating an upward flow of smoke;

introducing water into an element member axially disposed within the conduit member; and causing the element member to spin within the conduit member, wherein the spinning of the element member causes a turbulent flow of the water within the conduit member, the turbulent flow of the water contacting and cleaning the upward flow of smoke.

10. The method of claim 9 wherein the element member is caused to spin up to 6,000 RPM.

11. The method of claim 9 wherein the element member comprises an internal tube which receives the water.

12. The method of claim 11 wherein an annular space is defined between the element member and the conduit member.

13. The method of claim 12 wherein the element member comprises at least one radially facing outlet which provides a hydraulic passage for the water from the internal tube to the annular space.

14. A smoking system comprising:

a chamber in which a product is combusted resulting in product smoke;

a conduit member connected to the chamber, the conduit member having an upward end and a lower end, wherein the product smoke flows into the conduit member from the chamber and towards the upward end;

an element member disposed within the conduit member, wherein the element member comprises an internal tube and at least one radially facing outlet providing a hydraulic passage from the internal tube to an inside space of the conduit member;

a water delivery mechanism which delivers water to the upward end of the conduit member wherein the water flows from the upward end of the conduit member and into the internal tube; and a means for spinning the element member, wherein as the element member spins, water contained in the internal tube flows through the radially facing outlet into the inside space of the conduit member, falls through the conduit member towards the lower end and encounters product smoke flowing toward the upward end.

15. The smoking system of claim 14 wherein the element member is configured to rotate up to 6,000 RPM.

16. The smoking system of claim 14 wherein the water delivery mechanism comprises a reservoir which stores and circulates the water.

17. The smoking system of claim 16 wherein the water delivery mechanism comprises a pump.

18. The smoking system of claim 17 wherein the smoking delivery system comprises a base, wherein the conduit member extends upwardly from the base.

19. The smoking system of claim 18 wherein the water delivery mechanism is contained within the base.

* * * * *